US006279269B1

(12) United States Patent
Isomura et al.

(10) Patent No.: US 6,279,269 B1
(45) Date of Patent: Aug. 28, 2001

(54) WINDOW REGULATOR FOR A VEHICLE

(75) Inventors: Yukio Isomura; Sukekazu Asada; Hirokazu Suzumura, all of Aichi-ken (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/470,889

(22) Filed: Dec. 22, 1999

(30) Foreign Application Priority Data

Dec. 25, 1998 (JP) ..... 10-368678

(51) Int. Cl.[7] ..... E05F 11/44
(52) U.S. Cl. ..... 49/351
(58) Field of Search ..... 49/348, 349, 350, 49/351, 501

(56) References Cited

U.S. PATENT DOCUMENTS 3,897,652 * 8/1975 Hess ..... 49/351
4,843,760 * 7/1989 Hlousek ..... 49/351
4,846,591 * 7/1989 Dauvergne ..... 49/351 X
6,052,945 * 4/2000 Asada et al. ..... 49/351

FOREIGN PATENT DOCUMENTS 62-144380 9/1987 (JP) .

* cited by examiner

*Primary Examiner*—Jerry Redman
(74) *Attorney, Agent, or Firm*—Finnegan, Henderson, Farabow, Garrett & Dunner, L.L.P.

(57) ABSTRACT

According to the present invention, on the through opening edge portion, the flange portion is formed, and by arranging the outer surface of the axle portion to slide and rotate on the inner face of the flange portion, the first and second equalizer arms are pivotally supported by the lift arm. The circular projected portion formed around the axle portion contacts on the lift arm face to provide the predetermined clearance between the top portion of the flange portion and the lift arm face, and undesirable friction increase or stick slip there between is avoided. The lift arm and the first and second equalizer arms can be made of thinner steel plate material, and weight and cost reduction is obtained. The flange portion and the through opening are formed by burring on the lift arm, and also the axle portion and the circular projected portions are formed by stamping directly on the first equalizer, and also the weight and cost reduction of the window regulator is realized.

4 Claims, 3 Drawing Sheets

WINDOW REGULATOR FOR A VEHICLE

FIELD OF THE INVENTION

The present invention relates to a window regulator for a vehicle, and more particularly to a window regulator having light weight.

BACKGROUND OF THE INVENTION

Unexamined Published Japanese Utility Model Application (Kokai) No.62(1987)-144380 discloses a window regulator device which includes a lift arm being pivotally connected with a door panel at its one end and engages with a drive mechanism at its another end, a first and second equalizer arms pivotally arranged on the lift arm. The lift arm has a through opening, and the first and second equalizer arms have axle portions respectively. The first equalizer arm is located on the one side of the life arm and its axle portion is inserted to the lift arm's through opening. The second arm is located on the other side of the lift arm and also its axle portion is inserted to the lift arm's through opening. The two axle portion of the both equalizer arms are welded in the lift arm's through opening. The lift arm's through opening pivotally supports the welded axle portion.

However, the window regulator device having foregoing configuration, especially in a case the lift arm's plate thickness is thin, and enough bearing support area for the axle portion is not obtained, tends to increase its operation friction force and suffer luck of durability.

SUMMARY OF THE INVENTION

It is, therefore, an object of the present invention to provide a window regulator for a vehicle which overcomes the foregoing drawbacks.

In order to achieve the object, there is provided window regulator for a vehicle, including: a lift arm pivotally supported on a door panel and connected with window glass at its one end, and engaging with a drive mechanism at its other end, a first and second equalizer arms pivotally supported on the lift arm; wherein a through opening is formed on said arm. A flange is formed on the trough opening edge of the lift arm. An axle portion is formed on the first equalizer arm to penetrate the trough opening, to be connected with the second equalizer arm and to slide on the inside face of the trough opening.

According to another aspect of the invention, the first circular projected portion contacts on the lift arm face to provide a predetermined clearance between the top portion of the flange arm formed to surround the axle portion and the first equalizer arm.

According to another aspect of the invention, the window regulator for a vehicle includes the window regulator for a vehicle wherein the second equalizer has a second circular projected portion around said axle portion to slide on the lift arm face.

According to another aspect of the invention the window regulator for a vehicle includes the through opening and the flange portion are formed by burring process.

BRIEF DESCRIPTION OF THE DRAWING FIGURES

The foregoing and additional features of the present invention will be more apparent from the following detailed description of a preferred embodiment thereof when considered with reference to the attached drawings, in which.

DETAILED DESCRIPTION OP THE PREFERRED EMBODIMENTS

A window regulator device for a vehicle in accordance with a preferred embodiment of the present invention will be described with reference to the attached drawings.

Figure 1:
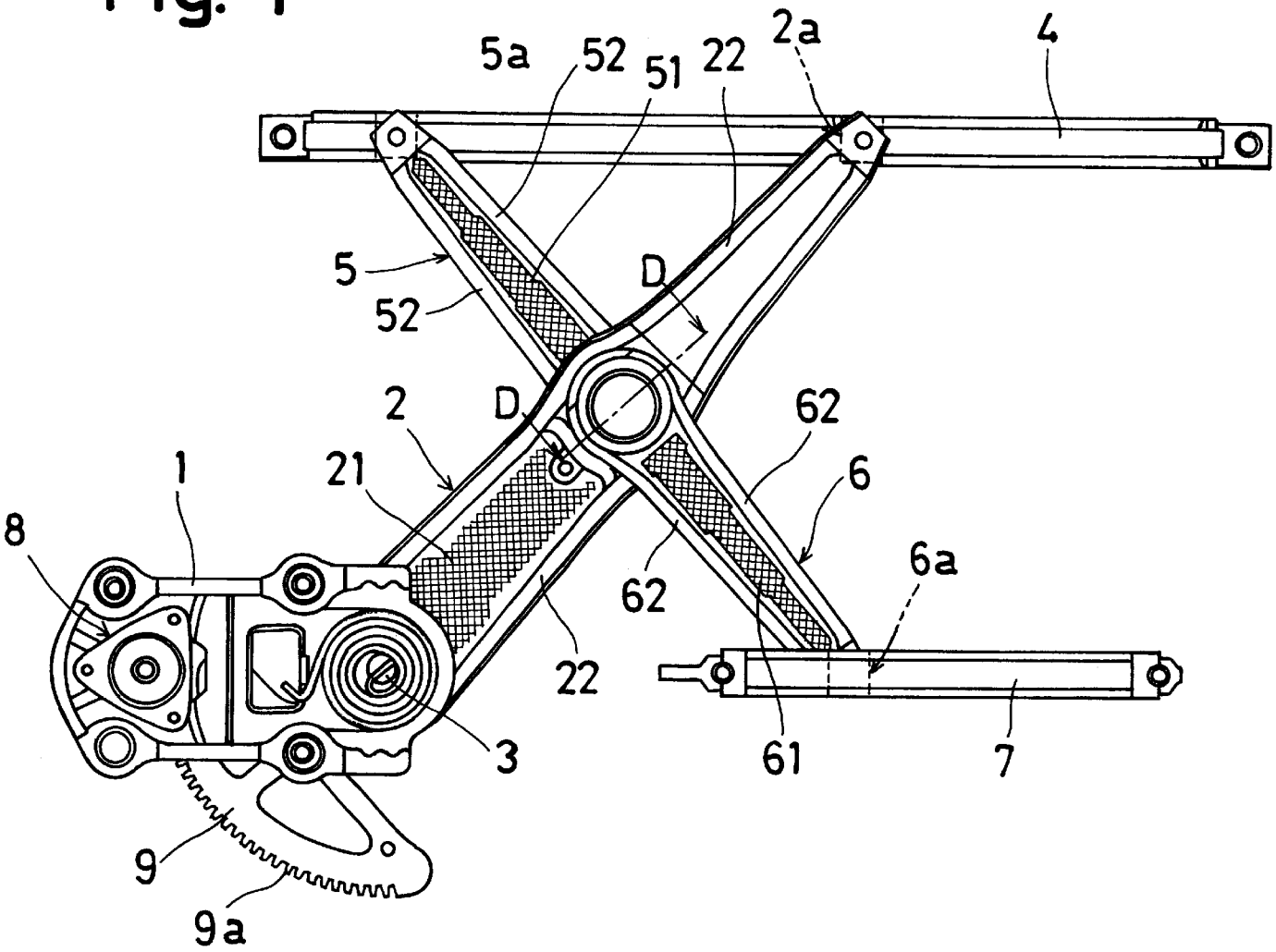
FIG. 1 is a front view of the window regulator in accordance with the present invention.
Figure 2:
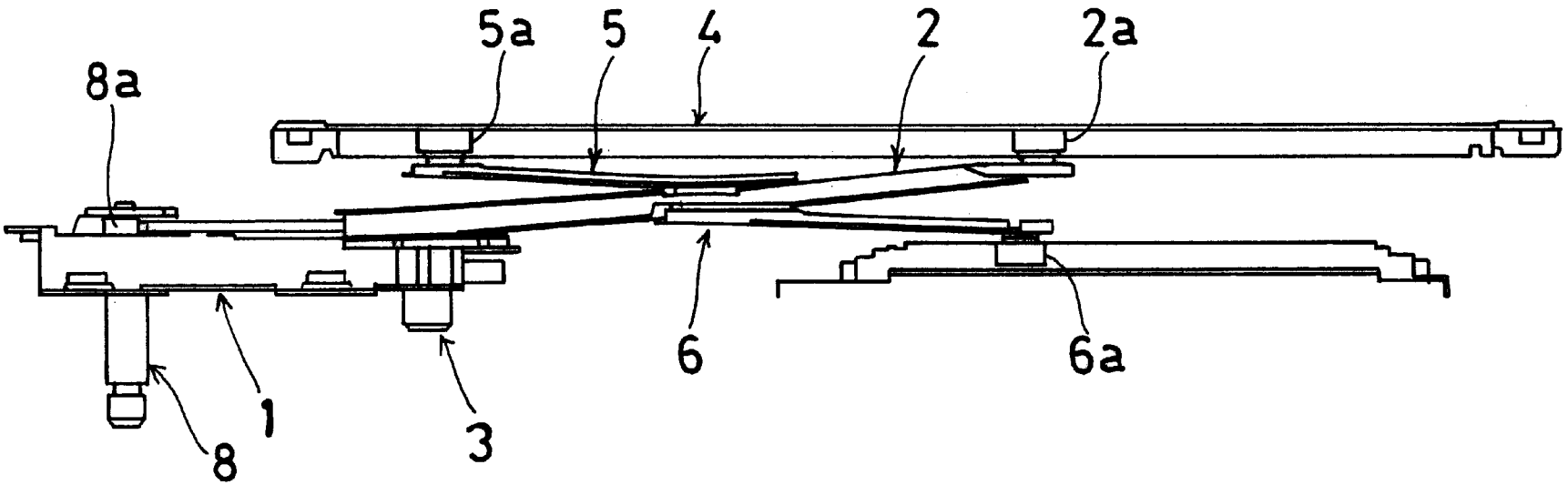
FIG. 2 is a top view of the window regulator in accordance with the present invention.

As shown in FIG. 1 and FIG. 2, on a base plate 1 fixed on a door panel (not shown) of a vehicle, a lift arm 2 is pivotally supported by a pin 3 at its end portion. The top end portion of the lift arm 2 is supported to slide in the rail 4 through an intermediate of a shoe 2*a*. Around on the center portion of the lift arm 2, an upper and a lower equalizer arms 5,6 are pivotally arranged and rotate in a body. The other end of the upper equalizer arms 5 is supported to slide in the rail 7 which is fixed on the door panel through an intermediate of a shoe 6*a*. The rails 4, 7 are located in parallel each other and extend in front and rear direction of the door (right and left direction in FIG. 11) The lift arm 2 and the upper and lower arms are made of high tension strength steel plate (with thickness of 0.8 mm to 1.2 mm), their surface are formed with stamped irregularities 21,51,61, and ribs 22,52,62 are formed on their edges to increase their surface stiffness.

A drive mechanism 8 is supported on the base plate 1. The drive mechanism could be well known motor type or hand driven type, and comprises a pinion gear 8*a* driven by the motor or the operation handle. On the base end portion of the lift arm 2, a sector gear 9 is fixed the sector gear meshes with the pinion gear 8*a* of the drive mechanism 8.

When the drive mechanism 8 drives, the lift arm 2 is rotated through the meshing between the pinion gear 8*a* of the drive mechanism 8 and circular gear portion 9*a* of the sector gear 9. By the lift arm's 2 rotation, the rail 4 is moved to the door's up or down direction together with a window glass and opening or closing operation of the vehicle window is performed. During the opening or closing operation, the shoe 2*a* slides in the rail 4 and compensates the dimensional difference between the lift arm 2 and the rail 4 occurred while the lift arm's 2 up or down rotational movement. The upper and lower equalizer arms 5,6 rotate on the lift arm 2 while the rail 4 up and down movement, and the rail 4 attitude through the process is maintained, and the shoes 5*a*, 6*a* slip in the rails 4, and 7.

Figure 3:
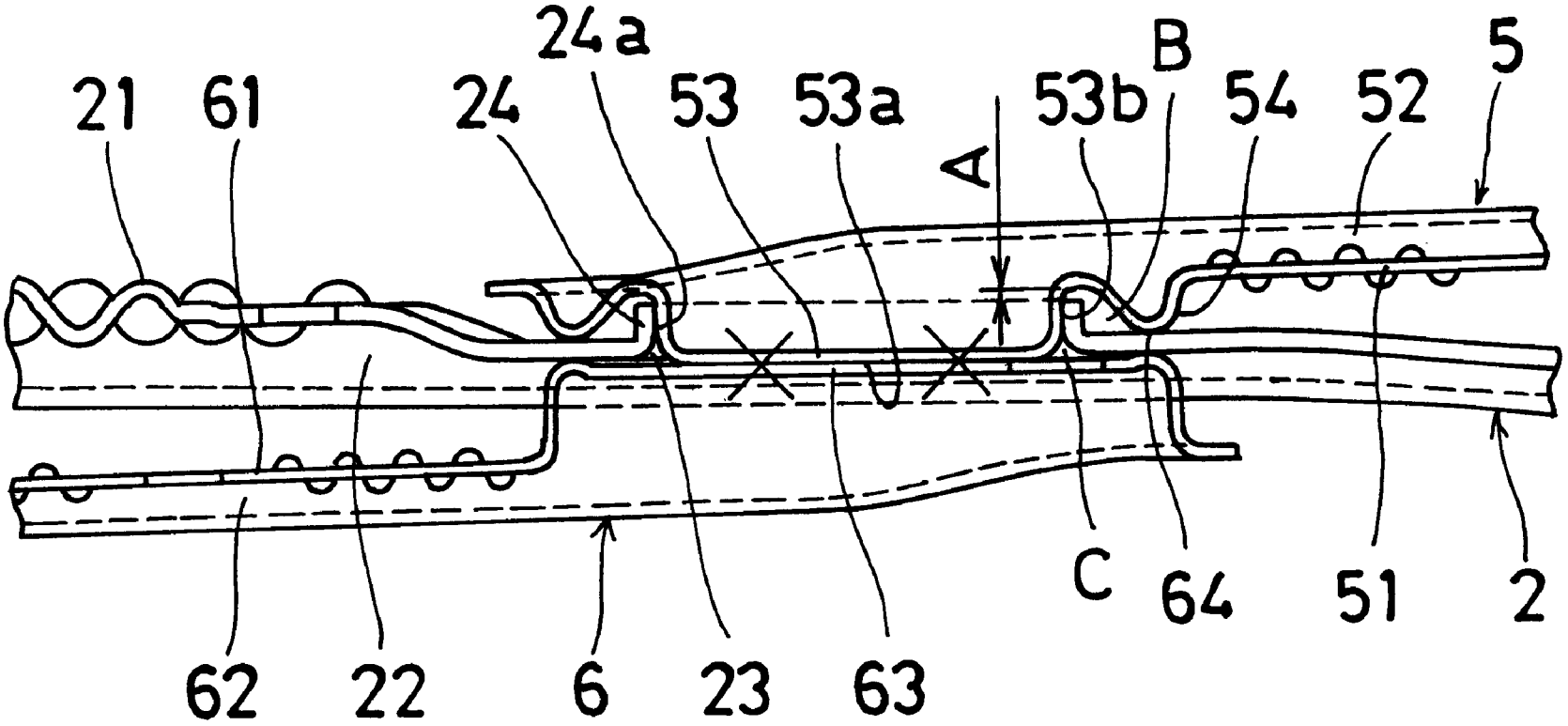
FIG. 3 is cross section view of the window regulator at D—D in FIG. 1 in accordance with the present invention.

As shown in FIG. 3, on the around center portion of the lift arm 2, the trough opening 23 is formed. On the edge of the through opening 23, a flange portion 24 is formed by so called burring process and is standing up on the one side of lift arm 2. The upper equalizer arms 5 is arranged on the one side of the lift arm 2 and on its one end, an cylindrical axle portion 53 is formed by stamping process to plunge to the lift arm 2 side. The axle portion's 53 diameter is almost same with the through opening's 23 diameter and fit each other, and its height is a little higher than the flange portion's 24 height. On the upper equalizer arms 5, a circular projected portion 54 is formed on the outside of the axle portion 53 by stamping process on the same center with the axle portion 53. The circular projected portion 54 projects to the same direction as the axle 53, the lift arm 2 side. Its height is higher than the flange portion 24. The lower equalizer arms 6 is arranged on the other side of the lift arm 2. On, the one end of the lower equalizer arms 6, a cylindrical accept portion 63 is formed projecting toward the lift arm 2 by stamping process, and a circular projected portion 64 is formed by stamping process on the edge of the cylindrical accept portion 63.

The shaft portion 53 of the upper equalizer arm 5 plunges into the through opening 23 and penetrates the lift arm 2, and the top face 53*a* of the shaft portion 53 is welded with the accept portion 63 of the lower arm 6. In this arrangement, the top of the circular projected portion 54 contacts on the one face of the lift arm 2, and the top of the circular projected portion 54 contacts on the one face of the lift arm 2, the other circular projected portion 64 contacts on the other face of the lift arm 2, thus the lift arm 2 is supported on its both side by two circular projected portion 54, 64. The outer face of the axle portion 53 slides on the inside wall 24*a* of the flange 24, and the upper and lower equalizer arms 5,6 are pivotally supported by the lift arm 2.

A predetermined clearance A is prepared between the top portion of the flange 24 and the upper equalizer arm 5 by the contact engagement of the circular projected portion 54 with the lift arm 2 face. This clearance A makes possible to avoid the friction increase or the stick slip rotation between the upper and lower equalizer arms 5,6 and the lift arm 2. Two closed spaces S,C are formed by the contacts of two circular projected portion's 54, 64 top portions on the lift arm 2 faces. The closed spaces S,C provide lubricating grease reserve spaces for the bearing portion between the axle portion 53 outer face 53*b* and the flange portion 24 inner face 24*a*, and keep the smooth rotation between the upper and lower equalizer arms 5,6 and the lift arm 2. The circular projected portion's 54, 64 top portions on the lift arm 2 face are also lubricated by the grease reserved there.

Foregoing example discloses the upper equalizer 5 having axle portion 53 and the circular projected portion 54 and the accept portion 63 on the lower equalizer 6. However, it is obvious the reversed arrangement of them can also realize the window regulator,based on the present invention.

What is claimed is:

1. A window regulator for a vehicle, comprising:

a lift arm having opposite side faces, a through opening, and a flange projecting to a projecting edge spaced from one of the opposite side faces and extending about the periphery of the through opening, the lift arm being pivotally supported on a panel of the vehicle and connected to a window glass at one end, and to a drive mechanism at another end;

first and second equalizer arms pivotally supported on the lift arm;

an axle portion formed on the first equalizer arm to penetrate the through opening from the one side face of the lift arm, to be connected with the second equalizer arm; and a first projected portion on the first equalizer arm about the axle portion to slide on the one side face of the lift arm.

2. The window regulator for a vehicle according to claim 1, wherein the first projected portion contacts the one side face of the lift arm to provide a predetermined clearance between the projecting edge of the flange portion and the first equalizer arm.

3. The window regulator for a vehicle according to claim 1, including a second projected portion on the second equalizer about the axle portion to slide on the other of the opposite side faces of the lift arm.

4. The window regulator for a vehicle according to claim 1, wherein the flange portion is formed by burring the lift arm about the through opening.

* * * * *